US010952538B2

(12) United States Patent
Choi

(10) Patent No.: US 10,952,538 B2
(45) Date of Patent: Mar. 23, 2021

(54) SUPPORT ASSEMBLY OF FOLDABLE BED FRAME AND FOLDABLE BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 194 days.

(21) Appl. No.: 15/913,527

(22) Filed: Mar. 6, 2018

(65) Prior Publication Data

US 2018/0255936 A1 Sep. 13, 2018

(30) Foreign Application Priority Data

Mar. 7, 2017 (CN) ..... 201720213204.2

(51) Int. Cl.
*A47C 19/12* (2006.01)
*A47C 19/02* (2006.01)

(52) U.S. Cl.
CPC ..... *A47C 19/122* (2013.01); *A47C 19/02* (2013.01)

(58) Field of Classification Search
CPC ..... A47C 19/122; A47C 19/02; A47C 19/12; A47C 19/124; A47C 19/14; A47C 17/70; A47C 17/82; F16B 12/54; F16B 12/56; A61G 7/002
See application file for complete search history.

(56) References Cited

U.S. PATENT DOCUMENTS 807,909 A * 12/1905 Braznell ..... A47C 19/122 5/152
1,360,983 A * 11/1920 Burton ..... A47C 19/122 5/154
2,513,168 A * 6/1950 Gottlieb ..... A47C 19/122 5/111
2,651,787 A * 9/1953 Piliero ..... A47C 19/122 5/152
2,701,603 A * 2/1955 Coopersmith ..... A47C 4/22 297/19
4,048,683 A * 9/1977 Chen ..... A47C 19/122 5/180
5,257,428 A * 11/1993 Carroll ..... A47C 19/122 5/201

* cited by examiner

*Primary Examiner* — Robert G Santos
*Assistant Examiner* — Alison N Labarge
(74) *Attorney, Agent, or Firm* — Morgan, Lewis & Bockius LLP

(57) ABSTRACT

Disclosed are support assemblies and foldable bed frames. A foldable bed frame includes first and second frames, each having left and right frame bars. A foldable bed frame also includes a support assembly having first and second link units. The first link unit is slidably and rotatably coupled with proximal end portions of the left and right frame bars of the first frame, and the second link unit is slidably and rotatably coupled with proximal end portions of the left and right frame bars of the second frame. The first and second link units are fixedly coupled with each other with a space in between. When folded, the proximal end portions of the left and right frame bars of the first and second frames are disposed in the space between the first and second links, minimizing a length of the foldable bed frame when folded.

19 Claims, 4 Drawing Sheets

SUPPORT ASSEMBLY OF FOLDABLE BED FRAME AND FOLDABLE BED FRAME HAVING SAME

CROSS-REFERENCE TO RELATED APPLICATIONS

The present application claims priority to Chinese Utility Model Application CN 201720213204.2 filed Mar. 7, 2017. The disclosure of the application is incorporated herein for all purposes by reference.

FIELD OF THE INVENTION

The present invention generally relates to support assemblies and foldable bed frames. More particularly, the present invention relates to support assemblies and foldable bed frames with minimized sizes when folded.

BACKGROUND

Nowadays, foldable beds have become increasingly popular. A foldable bed generally includes a foldable bed frame, support legs, and a mattress placed on the foldable bed frame. However, most of current foldable bed frames are not designed to minimize the sizes when folded. As a result, they require large storage spaces and are inconvenient to use and transport.

Given the current state of the art, there remains a need for support assemblies, and foldable bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides support assemblies and foldable bed frames with minimized folded sized.

In various exemplary embodiments, the present invention provides a foldable bed frame including a first frame, a second frame and a support assembly. Each of the first and second frames includes a left frame bar and a right frame bar. The support assembly includes a first link unit and a second link unit fixedly coupled with each other with a space in between. The first link unit is slidably and rotatably coupled with proximal end portions of the left and right frame bars of the first frame, and the second link unit is slidably and rotatably coupled with proximal end portions of the left and right frame bars of the second frame. When folded, the proximal end portions of the left and right frame bars of the first and second frames are disposed in the space between the first and second links, thereby minimizing a length of the foldable bed frame when folded.

In some exemplary embodiments, the first and second link units are symmetric with respect to each other.

In many exemplary embodiments, for a respective frame in the first and second frames, a corresponding link unit in the first and second link units includes a left slider, a right slider, a left vertical support, and a right vertical support. The left slider is slidably coupled with the proximal end portion of the left frame bar of the respective frame, and the right slider is slidably coupled with the proximal end portion of the right frame bar of the respective frame. The left vertical support has an upper end pivotally coupled with the left slider, and the right vertical support has an upper end pivotally coupled with the right slider. In some exemplary embodiments, the left and right vertical supports are coupled with each other at lower ends thereof by a lateral support, or integrally formed with the lateral support.

In some exemplary embodiments, the corresponding link unit further includes a left rotating link and a right rotating link. The left rotating link has a first end pivotally connected with the left vertical support and a second end pivotally connected with a proximal end of the left frame bar of the respective frame. The right rotating link has a first end pivotally connected with the right vertical support and a second end pivotally connected with a proximal end of the right frame bar of the respective frame.

In an exemplary embodiment, the support assembly further includes one or more spacing links disposed between the first and second link units. Each spacing link has a first end fixedly coupled with the first link unit and a second end fixedly coupled with the second link unit.

In some exemplary embodiments, the support assembly further includes a plurality of wheels at a lower part of the support assembly. In an exemplary embodiment, each wheel is disposed below and rotatably coupled with a lateral support of the support assembly.

In many exemplary embodiments, the foldable bed frame further includes a first leg assembly and a second leg assembly, each including a left leg and a right leg. The left leg of the first leg assembly has an upper end pivotally connected with the first frame at a left distal side of the first frame, and the right leg of the first leg assembly has an upper end pivotally connected with the first frame at a right distal side of the first frame. The left leg of the second leg assembly has an upper end pivotally connected with the second frame at a left distal side of the second frame, and the right leg of the second leg assembly has an upper end pivotally connected with the second frame at a right distal side of the second frame.

In some exemplary embodiments, the foldable bed frame further includes a plurality of link bars, each having a first end pivotally connected to the first or second link unit and a second end pivotally connected to the left or right leg of the first or second leg assembly.

In some exemplary embodiments, the left and right frame bars of a respective frame in the first and second frames are connected to each other at dismal ends thereof by a distal end frame bar, or integrally formed with the distal end frame bar. In an exemplary embodiment, a U-shaped bar is coupled with the distal end frame bar and disposed uprightly in the unfolded state. The U-shaped bar serves as a handle to facilitate easy folding and unfolding of the foldable bed, or as a spacer to prevent the first and second frames from rotating beyond its folded state.

In some exemplary embodiments, the first and second frames are symmetric with respect to each other.

In various embodiments, the present invention provides a support assembly for connecting first and second frames of a foldable bed frame. The support assembly includes a first link unit and a second link unit. The first link unit is configured to slidably and rotatably couple with proximal end portions of left and right frame bars of the first frame, and the second link unit is configured to slidably and rotatably couple with proximal end portions of left and right frame bars of the second frame. The first and second link units are fixedly coupled with each other with a space in between. When folded, the proximal end portions of the left and right frame bars of the first and second frames are disposed in the space between the first and second links, thereby minimizing a length of the foldable bed when folded.

In some exemplary embodiments, the first or the second link unit includes a left slider, a right slider, a left vertical support and a right vertical support. The left slider is slidably coupled with the proximal end portion of the left frame bar of the first or second frame, and the right slider is slidably coupled with the proximal end portion of the right frame bar of the first or second frame. The left vertical support has an upper end pivotally coupled with the left slider, and the right vertical support has an upper end pivotally coupled with the right slider.

In some exemplary embodiments, the first or the second link unit further includes a left rotating link and a right rotating link. The left rotating link has a first end pivotally connected with the left vertical support and a second end pivotally connected with a proximal end of the left frame bar of the respective frame. The right rotating link has a first end pivotally connected with the right vertical support and a second end pivotally connected with a proximal end of the right frame bar of the respective frame.

The support assemblies and foldable bed frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of exemplary embodiments of the invention.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from the spirit and scope of the embodiments, as will be apparent to those skilled in the art. The specific embodiments described herein are offered by way of example only.

Embodiments of the present invention are described in the context of support assemblies and foldable bed frames. The bed frames are of various sizes including but not limited to twin, full, queen and king sizes, and of various shapes including but not limited to rectangles and squares. Also, the bed frames can be made of various materials including but not limited to metals such as steel, plastics and woods.

Figure 1:
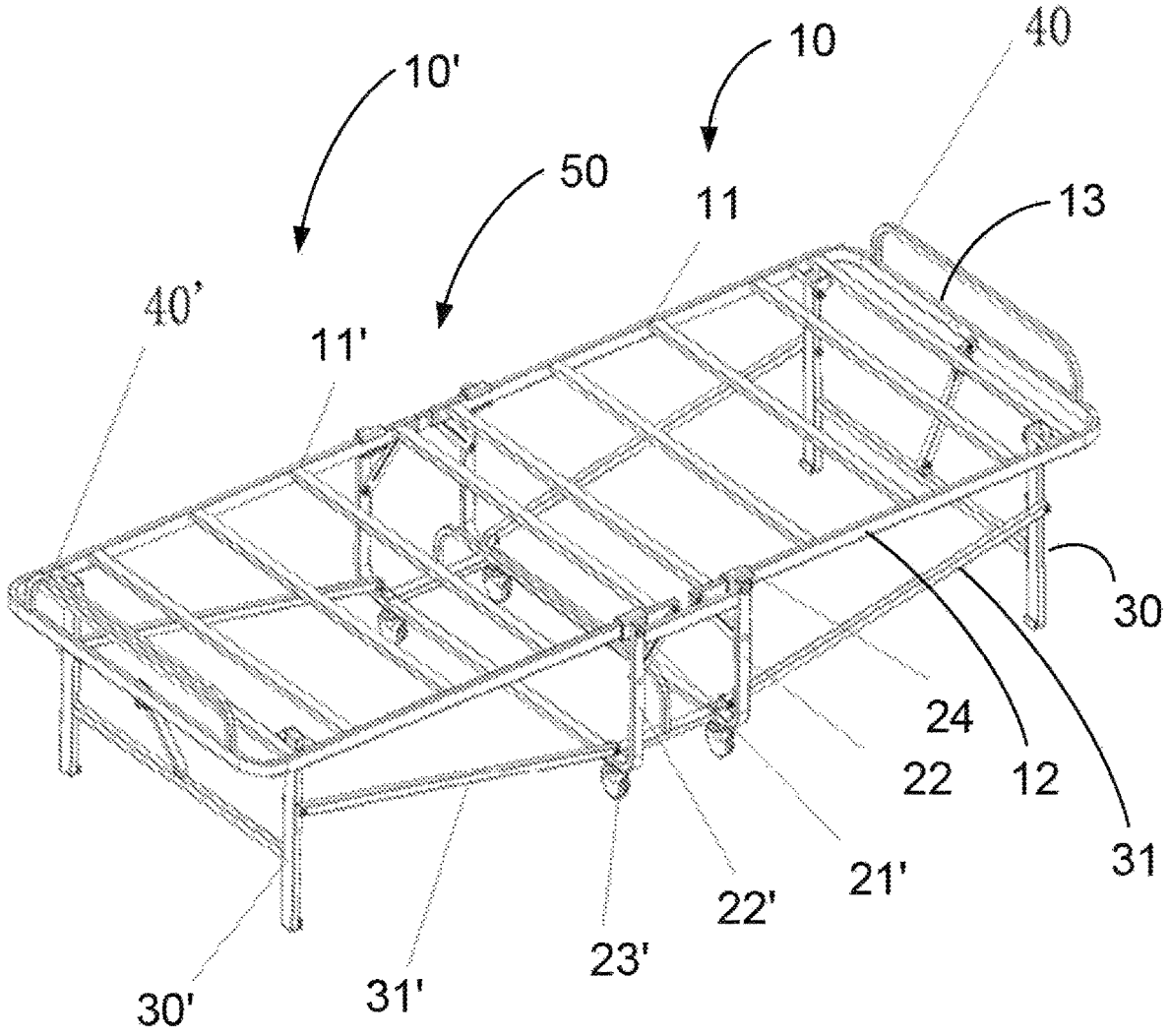
FIG. 1 is a schematic perspective view illustrating a foldable bed frame in an unfolded state in accordance with exemplary embodiments of the present invention.
Figure 2:
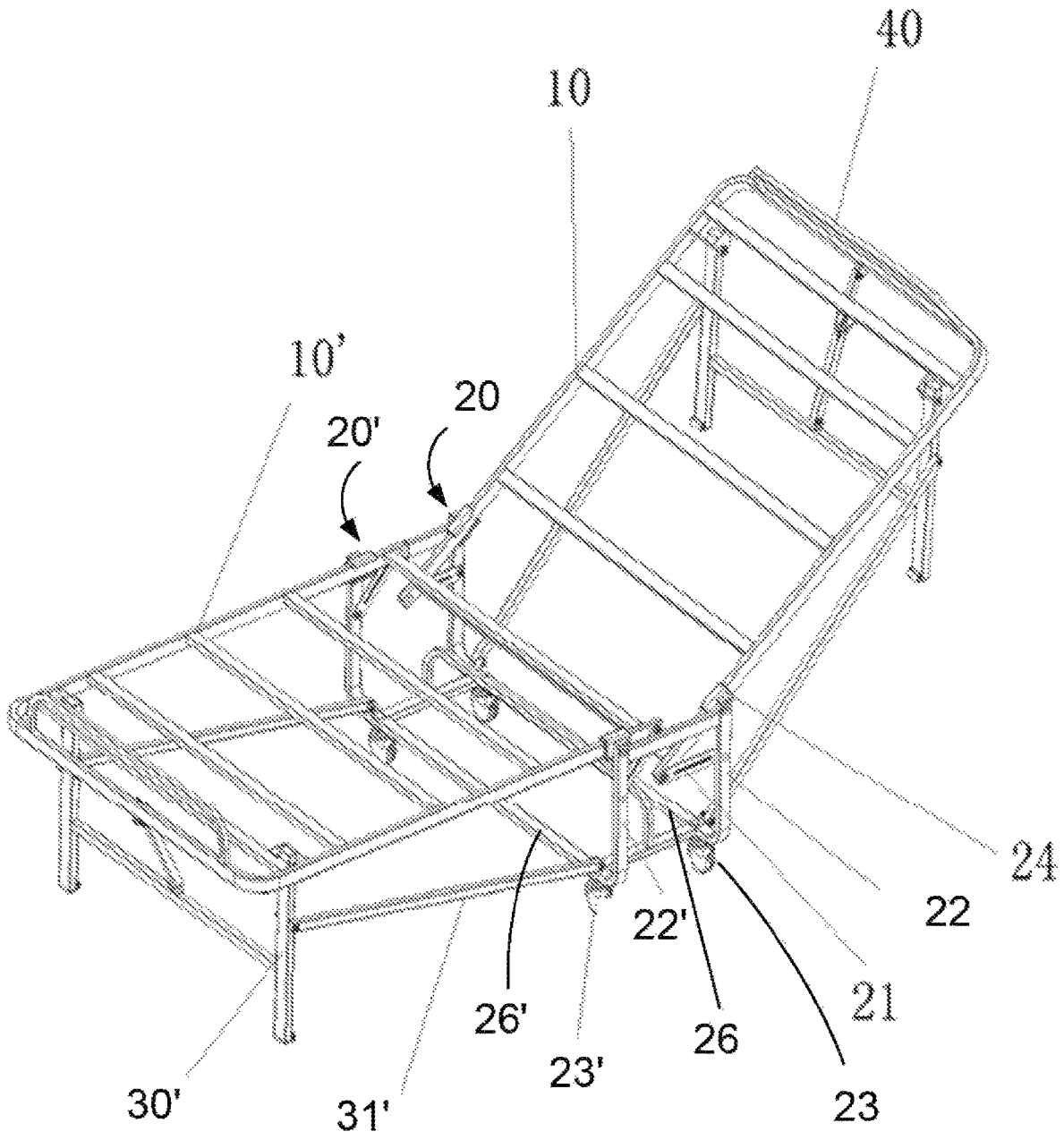
FIG. 2 is a schematic perspective view illustrating the foldable bed frame of FIG. 1 in a first partially folded state.
Figure 3:
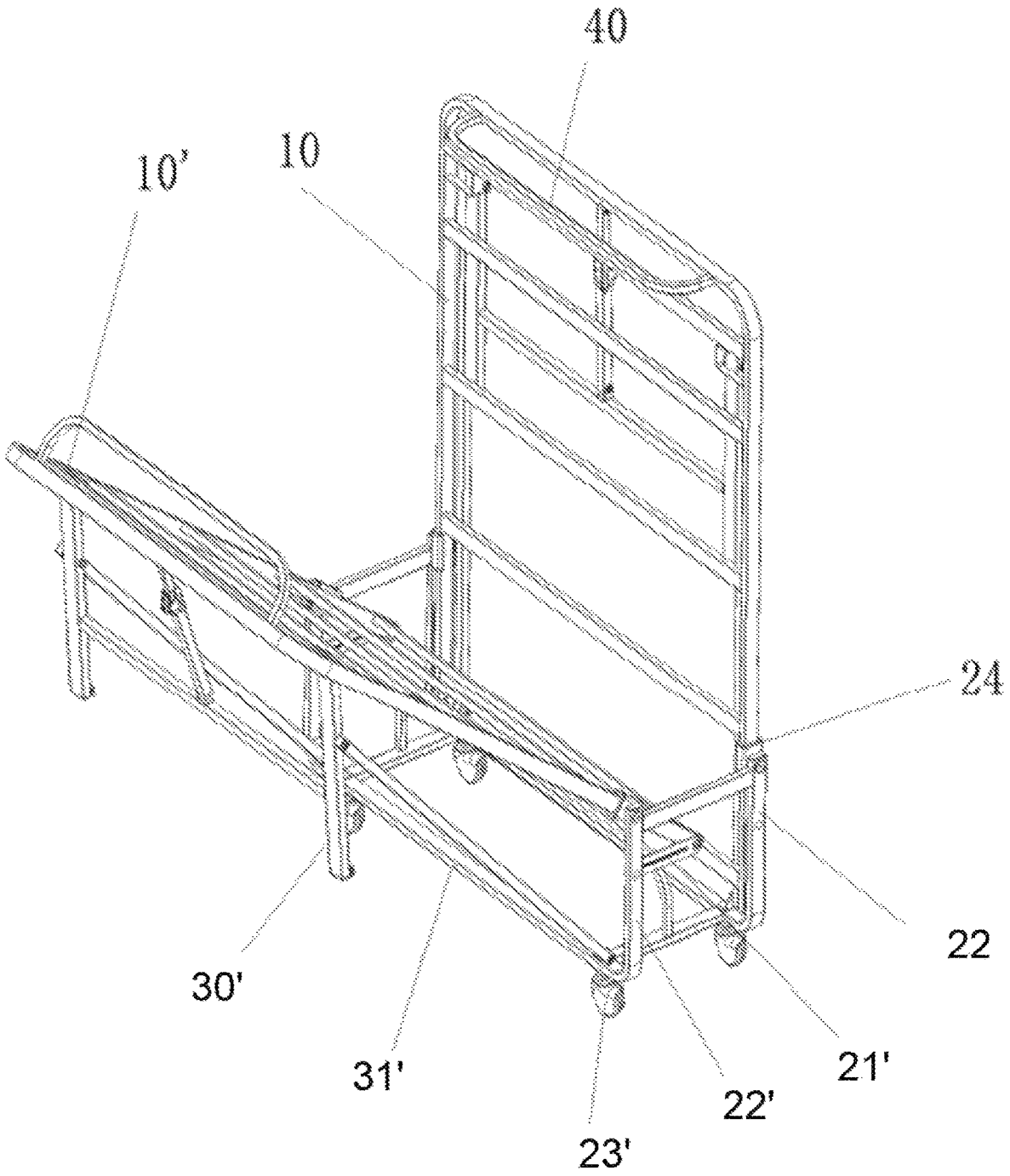
FIG. 3 is a schematic perspective view illustrating the foldable bed frame of FIG. 1 in a second partially folded state.

Generally, a bed frame of the present invention includes a plurality of frames pivotally connected with each other by one or more support assemblies. As an example, FIG. 1 illustrates first frame 10 and second frames 10' connected with each other at their proximal sides by support assembly 50. The frames can be but do not necessarily have to be identical or symmetric with respect to each other. By way of example, FIG. 1 illustrates symmetric first and second frames.

As used herein, the sides at which first and second frames are connected to each other are referred to as their proximal sides, and the sides opposite the proximal sides are referred to as their distal sides. For instance, in FIG. 1, the proximal sides of first and second frames are in the middle of the foldable bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame. It should also be noted that the term "end" of a part (e.g., a bar, a link) as used herein refers to a tip and/or a portion adjacent the tip of the part.

In many embodiments, each of the first and second frames includes a left frame bar and a right frame bar. For instance, FIG. 1 illustrates first frame 10 having left frame bar 11 and right frame bar 12. In some embodiments, the left and right frame bars of the first or second frame are connected to each other at their dismal ends by a distal end frame bar, or integrally formed with the distal end frame bar. For instance, FIG. 1 illustrates the dismal ends of left frame bar 11 and right frame bar 12 are connected or integrally formed with distal end frame bar 13. In many cases, left frame bar 11, distal end frame bar 13, and right frame bar 12 collectively form a U-shaped peripheral frame, which can be made, for instance, by bending a bar or the like.

Referring to FIGS. 1-4, in various embodiments, two frames (e.g., the first and second frames) are pivotally connected with each other by a support assembly of the present invention. In many embodiments, corresponding to each of the first and second frames, the support assembly includes a link unit configured to couple with the frame. For instance, support assembly 50 includes first link unit 20 slidably and rotatably coupled with proximal end portions of the left and right frame bars of first frame 10, and second link unit 20' slidably and rotatably coupled with proximal end portions of the left and right frame bars of second frame 10'. The first and second link units can be but do not necessarily have to be identical or symmetric with respect to each other. By way of example, FIGS. 1-4 illustrate symmetric first and second link units.

In some embodiments, for a respective frame in the first and second frames, a corresponding link unit in the first and second link units includes one or more sliders slidably coupled with the respective frame, and one or more vertical supports pivotally coupled with the one or more sliders. For instance, in the illustrated embodiment, first link unit 20 includes two sliders 24, one disposed at the left side of the bed frame and one disposed at the right side of the bed frame. The left slider is slidably coupled with the proximal end portion of left frame bar 11 of first frame 10, and the right slider is slidably coupled with the proximal end portion of right frame bar 12 of first frame 10. First link unit 20 also includes two vertical support 22, one disposed at the left side of the bed frame and one disposed at the right side of the bed frame. The left vertical support has an upper end pivotally coupled with the left slider, and the right vertical support has an upper end pivotally coupled with the right slider.

Similarly, in the illustrated embodiment, second link unit 20' includes two sliders and two vertical supports. The left slider is slidably coupled with the proximal end portion of the left frame bar of the second frame, and the right slider is slidably coupled with the proximal end portion of the right frame bar of the second frame. The left vertical support has an upper end pivotally coupled with the left slider, and the right vertical support has an upper end pivotally coupled with the right slider.

Figure 4:
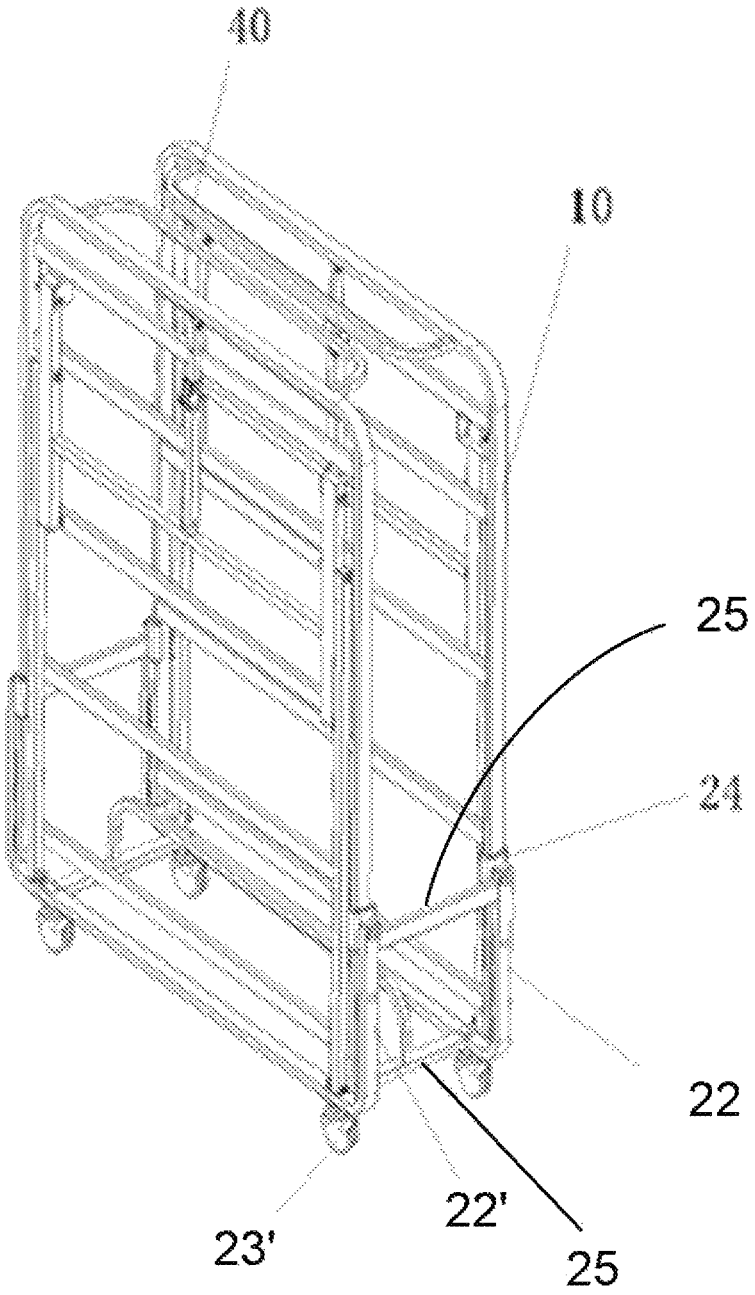
FIG. 4 is a schematic perspective view illustrating the foldable bed frame of FIG. 1 in a folded state.

First link unit 20 and second link unit 20' are fixedly coupled with each other with a space in between. For instance, in some embodiments, the support assembly includes one or more spacing links 25 disposed between the first and second link units. Each spacing link 25 has a first end fixedly coupled with the first link unit and a second end fixedly coupled with the second link unit. As illustrated in FIG. 4, when folded, the proximal end portions of the left and right frame bars of the first and second frames are disposed in the space between the first and second links. As such, the length of the foldable bed when folded is minimized.

In some embodiments, for a respective frame in the first and second frames, a corresponding link unit in the first and second link units includes one or more links configured to couple the frame with the vertical supports to further assist the folding and unfolding of the frame. For instance, in the illustrated embodiment, first link unit 20 includes two rotating links 21, one disposed at the left side of the bed frame and one disposed at the right side of the bed frame. The left rotating link has a first end pivotally connected with the left vertical support and a second end pivotally connected with the proximal end of the left frame bar of first frame 10. The right rotating link has a first end pivotally connected with the right vertical support and a second end pivotally connected with a proximal end of the right frame bar of first frame 10. Similarly, in the illustrated embodiment, second link unit 20' includes two rotating links 21' connecting the proximal ends of the left and right frame bars of second frame 10' with vertical supports 22' of second link unit 20'. When folding the bed frame, rotating links 21, 21' pull and rotate the proximal ends of the left and right frame bars into the space in between the first and second links. In an embodiment, rotating links 21, 21' also serve as stoppers to prevent the first and second frames from rotating beyond its folded state. When unfolding the bed frame, rotating links 21, 21' push and rotate the proximal ends of the left and right frame bars out of the space in between the first and second links.

In some embodiments, lower ends of the left and right vertical supports are coupled with each other by a lateral support, or integrally formed with the lateral support. For instance, in the illustrated embodiment, the lower ends of left and right vertical supports 22 are coupled with each other by lateral support 26, or integrally formed with lateral support 26. In many cases, the left vertical support, the lateral support and the right support collectively form a U-shaped support, which can be made, for instance, by bending a bar or the like. Similarly, in the illustrated embodiment, the lower ends of left and right vertical supports 22' are coupled with each other by lateral support 26', or integrally formed with lateral support 26'.

In many embodiments, the support assembly further includes a plurality of wheels disposed at a lower part of the support assembly. In the illustrated embodiment, the support assembly includes four wheels, with two wheels 23 disposed below and rotatably coupled with lateral support 26, and two wheels 23' disposed below and rotatably coupled with lateral support 26'.

In various embodiments, the foldable bed frame of the present invention also includes one or more leg assemblies, which can be the same as or different from each other. By way of example, FIGS. 1-4 illustrate two leg assemblies, with first leg assembly 30 coupled with first frame 10 at the distal side of first frame 10, and second leg assembly 30' coupled with second frame 10' at the distal side of the second frame 10'. In some embodiments, each of the first and second leg assembly includes a left leg and a right leg. The left leg of the first leg assembly has an upper end pivotally connected with the first frame at a left distal side of the first frame. The right leg of the first leg assembly has an upper end pivotally connected with the first frame at a right distal side of the first frame. The left leg of the second leg assembly has an upper end pivotally connected with the second frame at a left distal side of the second frame. The right leg of the second leg assembly has an upper end pivotally connected with the second frame at a right distal side of the second frame.

In some embodiments, the foldable bed frame of the present invention further includes a plurality of link bars, each having a first end pivotally connected to the first or second link unit and a second end pivotally connected to the left or right leg of the first or second leg assembly. For instance, in the illustrated embodiment, the foldable bed frame includes two first link bars 31, one disposed at the left side of the bed frame and one disposed at the right side of the bed frame. Each link bar 31 has a first end pivotally connected with first link unit 20 and a second end pivotally connected with first leg assembly 30. The foldable bed frame also includes two second link bars 31', one disposed at the left side of the bed frame and one disposed at the right side of the bed frame. Each link bar 31' has a first end pivotally connected with second link unit 20' and a second end pivotally connected with second leg assembly 30'. When folding the bed frame, link bars 31, 31' pull and rotate the first and second leg assemblies towards the first and second frames, respectively. When unfolding the bed frame, link bars 31, 31' push and rotate the first and second leg assemblies away from the first and second frames, respectively.

In some embodiments, for a respective frame in the first and second frames, a U-shaped bar is coupled with the distal end frame bar and disposed uprightly in the unfolded state. For instance, FIGS. 1-4 illustrate first U-shaped bar 40 coupled with the distal end frame bar of first frame 10 and second U-shaped bar 40' coupled with the distal end frame bar of second frame 10'. The U-shaped bar can serve as a handle to facilitate easy folding and unfolding of the foldable bed. In an exemplary embodiment, the U-shaped bar also serves as a spacer to prevent the first and second frames from rotating beyond its folded state, as illustrated in FIG. 4.

The support assembly and the foldable bed frame can include additional, alternative, or optional elements. For instance, the bed frame can include one or more frame lateral bars, one or more leg lateral bars, and/or one or more oblique supports that connect the first and second leg assemblies with the first and second frames.

The foldable bed frame of the present invention is easy to use. For instance, to fold the foldable bed frame, simply rotate the first and/or second frame toward each other (e.g., by pulling up the handle). As such, sliders 24, 24' slide along the left and right frame bars of the first and second frames, and rotating links 21, 21' pull and rotate the proximal ends of the left and right frame bars into the space in between the first and second links. In the meantime, link bars 31, 31' pull and rotate the first and second leg assemblies towards the first and second frames, respectively. As illustrated in FIG. 4, when folded, the foldable bed frame of the present invention has a substantially box-like shape. Reversing the processes will unfold the bed frame.

With the proximal portions of the left and right frame bars of the first and second frames disposed in the space between the first and second links of the support assembly, the length of the foldable bed frame when folded is minimized. As such, the foldable bed frame of the present invention requires less storage space.

Further, when folded, wheels 23, 23' are disposed at the bottom of the folded bed frame. As such, it is easy and convenient to move around the foldable bed frame of the present invention.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "longitudinal" or "lateral", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first frame could be termed a second frame, and, similarly, a second frame could be termed a first frame, without changing the meaning of the description, so long as all occurrences of the "first frame" are renamed consistently and all occurrences of the "second frame" are renamed consistently.

What is claimed is:

1. A foldable bed frame comprising:

a first frame and a second frame, each comprising a left frame bar and a right frame bar; and a support assembly comprising a first link unit disposed adjacent to the first frame and a second link unit disposed adjacent to the second frame, wherein the first link unit and the second link unit are fixedly coupled with each other with a fixed space in between, the first link unit is slidably and rotatably coupled with proximal end portions of the left and right frame bars of the first frame, the second link unit is slidably and rotatably coupled with proximal end portions of the left and right frame bars of the second frame, and each of the first and second link units comprises a left slider slidably coupled with the proximal end portion of the left frame bar of the first or second frame to allow the proximal end portion of the left frame bar to slide with respect to the left slider and a right slider slidably coupled with the proximal end portion of the right frame bar of the first or second frame to allow the proximal end portion of the right frame bar to slide with respect to the right slider, such that when folded, a proximal end of the proximal end portions of the left and right frame bars of the first and second frames are disposed in the fixed space between the first and second links, thereby minimizing a length of the foldable bed frame when folded.

2. The foldable bed frame of claim 1, wherein for a respective frame in the first and second frames, a corresponding link unit in the first and second link units further comprises:

a left vertical support having an upper end pivotally coupled with the left slider; and a right vertical support having an upper end pivotally coupled with the right slider.

3. The foldable bed frame of claim 2, wherein the corresponding link unit further comprises:

a left rotating link having a first end pivotally connected with the left vertical support and a second end pivotally connected with a proximal end of the left frame bar of the respective frame; and a right rotating link having a first end pivotally connected with the right vertical support and a second end pivotally connected with a proximal end of the right frame bar of the respective frame.

4. The foldable bed frame of claim 2, wherein the left and right vertical supports are coupled with each other at lower ends thereof by a lateral support, or integrally formed with the lateral support.

5. The foldable bed frame of claim 4, wherein the support assembly further comprises a plurality of wheels, each disposed below and rotatably coupled with the lateral support.

6. The foldable bed frame of claim 1, wherein the support assembly further comprises one or more spacing links disposed between the first and second link units, each spacing link having a first end fixedly coupled with the first link unit and a second end fixedly coupled with the second link unit.

7. The foldable bed frame of claim 1, wherein the support assembly further comprises a plurality of wheels at a lower part of the support assembly.

8. The foldable bed frame of claim 1, wherein the first and second link units are symmetric with respect to each other.

9. The foldable bed frame of claim 1, wherein the first and second frames are symmetric with respect to each other.

10. The foldable bed frame of claim 1, further comprising:

a first leg assembly and a second leg assembly, each comprising a left leg and a right leg, wherein the left leg of the first leg assembly has an upper end pivotally connected with the first frame at a left distal side of the first frame;

the right leg of the first leg assembly has an upper end pivotally connected with the first frame at a right distal side of the first frame;

the left leg of the second leg assembly has an upper end pivotally connected with the second frame at a left distal side of the second frame; and the right leg of the second leg assembly has an upper end pivotally connected with the second frame at a right distal side of the second frame.

11. The foldable bed frame of claim 10, further comprising:

a plurality of link bars, each having a first end pivotally connected to the first or second link unit and a second end pivotally connected to the left or right leg of the first or second leg assembly.

12. The foldable bed frame of claim 1, wherein the left and right frame bars of a respective frame in the first and second frames are connected to each other at distal ends thereof by a distal end frame bar, or integrally formed with the distal end frame bar.

13. The foldable bed frame of claim 12, wherein a U-shaped bar is coupled with the distal end frame bar and disposed uprightly in the unfolded state, wherein the U-shaped bar serves as a handle to facilitate easy folding and unfolding of the foldable bed, or as a spacer to prevent the first and second frames from rotating beyond its folded state.

14. A support assembly for connecting first and second frames of a foldable bed frame, the support assembly comprising:

a first link unit to be disposed adjacent to the first frame and to slidably and rotatably couple with proximal end portions of left and right frame bars of the first frame; and a second link unit to be disposed adjacent to the second frame and to slidably and rotatably couple with proximal end portions of left and right frame bars of the second frame, wherein the first and second link units are fixedly coupled with each other with a fixed space in between, each of the first and second link units comprises a left slider slidably coupled with the proximal end portion of the left frame bar of the first or second frame to allow the proximal end portion of the left frame bar to slide with respect to the left slider and a right slider slidably coupled with the proximal end portion of the right frame bar of the first or second frame to allow the proximal end portion of the right frame bar to slide with respect to the right slider, such that when folded, a proximal end of the proximal end portions of the left and right frame bars of the first and second frames are disposed in the fixed space between the first and second links, thereby minimizing a length of the foldable bed when folded.

15. The support assembly of claim 14, wherein the first or the second link unit further comprises:

a left vertical support having an upper end pivotally coupled with the left slider; and a right vertical support having an upper end pivotally coupled with the right slider.

16. The support assembly of claim 15, wherein the first or the second link unit further comprises:

a left rotating link having a first end pivotally connected with the left vertical support and a second end pivotally connected with a proximal end of the left frame bar of the respective frame; and a right rotating link having a first end pivotally connected with the right vertical support and a second end pivotally connected with a proximal end of the right frame bar of the respective frame.

17. The support assembly of claim 15, wherein the left and right vertical supports are coupled with each other at lower ends thereof by a lateral support, or integrally formed with the lateral support.

18. The support assembly of claim 17, further comprising a plurality of wheels, each disposed below and rotatably coupled with the lateral support.

19. The support assembly of claim 14, further comprising one or more spacing links disposed between the first and second link units, each spacing link having a first end fixedly coupled with the first link unit and a second end fixedly coupled with the second link unit.

* * * * *